US006591430B1

(12) United States Patent
Sledge

(10) Patent No.: US 6,591,430 B1
(45) Date of Patent: Jul. 15, 2003

(54) HEAD AND NECK SUPPORT APPARATUS

(76) Inventor: Wilson Harris Sledge, 744 John E. Sullivan, Byron, GA (US) 31008

( * ) Notice: Subject to any disclaimer, the term of this patent is extended or adjusted under 35 U.S.C. 154(b) by 16 days.

(21) Appl. No.: 10/011,701

(22) Filed: Nov. 13, 2001

(51) Int. Cl.[7] ..... A41D 13/00; A42B 7/00
(52) U.S. Cl. ..... 2/468; 2/421; 2/425
(58) Field of Search ..... 2/468, 425, 411, 2/416, 421, 410

(56) References Cited

U.S. PATENT DOCUMENTS

| | | | | |
|---|---|---|---|---|
| 3,134,106 A | * | 5/1964 | Shaffer et al. | 2/468 |
| 3,925,822 A | * | 12/1975 | Sawyer | 2/421 |
| 4,638,510 A | | 1/1987 | Hubbard | |
| 4,825,476 A | | 5/1989 | Andrews | |
| 5,272,770 A | | 12/1993 | Allen | |
| 5,581,816 A | | 12/1996 | Davis | |
| 5,930,843 A | | 8/1999 | Kelly | |
| 6,009,566 A | | 1/2000 | Hubbard | |
| 6,253,389 B1 | * | 7/2001 | Scaglione | 2/456 |
| 2002/0178492 A1 | * | 12/2002 | Ashline | 2/468 |

FOREIGN PATENT DOCUMENTS

| | | | |
|---|---|---|---|
| WO | WO 9103178 A1 * | 3/1991 | A42B/3/00 |

* cited by examiner

*Primary Examiner*—Rodney M. Lindsey
(74) *Attorney, Agent, or Firm*—Patent Focus, Inc.; Richard C. McComas

(57) ABSTRACT

An apparatus worn by a driver or user of vehicle: The apparatus has a yoke with an aperture sized to receive a user's head. The head of the user passes through the aperture and the yoke rests on the user's shoulders. The apparatus has two pairs of adjustable juxtaposition elongated substantially L-shaped flanges. The first pair of elongated substantially L-shaped flanges is adjustably connected to a helmet and the second pair is adjustably connected to the yoke. The helmet and second pair of elongated substantially L-shaped flanges arcuately traverse the first pair of elongated substantially L-shaped flanges in the horizontal plane thereby permitting movement of the user's head in the horizontal plane with respect to the user's field of view but preventing movement of the user's head in the vertical plane with respect to the user's field of view.

10 Claims, 4 Drawing Sheets

HEAD AND NECK SUPPORT APPARATUS

FIELD OF THE INVENTION

The invention relates, in general, to an apparatus worn by a driver or user of a high performance competition vehicle to prevent head and neck injuries to the driver or user during an accident. In particular, the invention relates to an apparatus that permits the driver's or user's head movement in the horizontal plane relative to the driver's or user's field of view and prohibits the driver's or user's head movement in the vertical plane relative to the driver's or user's field of view. More particularly, the invention relates to an apparatus that maintains the driver's or user's field of view in the horizontal plane while seated in the vehicle in a full upright position or in a modified seated position.

BACKGROUND OF THE INVENTION

High performance vehicles driven in competition sporting events travel at high speeds and in close proximity to other high performance vehicles. Generally, the competition sporting event is conducted on a closed, controlled racetrack. The spectators of the sporting event are typically separated from the racetrack by barriers to protect the spectators in case of vehicular accidents. The barriers are typically high concrete or steel walls that separate the spectators from the vehicles.

Unlike the driver of a passenger vehicle the driver of a high performance vehicles in competition have a field of view directed to the racetrack in front of the driver, to the right and to the left of the vehicle i.e., the high performance vehicle driver's field of view is in the horizontal plane parallel to the racetrack. The high performance vehicle's arrangement of the instrument panel is positioned to accommodate the driver's field of view in the horizontal plane. Movement of the driver's head in the vertical plane is not required as it is for a driver of a passenger type vehicle.

Typically, the torso of the driver of the competition vehicle is strapped or secured into the driver's seat or to the vehicle except for the driver's head. A helmet is worn by the driver to protect the head from impact during an accident involving another vehicle or the impact of his vehicle with the racetrack's retaining wall. If an accident occurs, the driver's torso remains stationary in relation to the seat to which he is strapped. The unrestrained head and neck of the driver may be violently forced forward, forced to the left or forced to the right in relation to the strapped-in driver's torso. The forces applied to the driver's head and neck during an accident may cause the driver's neck to break or suffer severe injuries.

An attempt in the past to prevent injuries to the driver's neck and head during an accident involved restraining the driver's head by connecting the helmet of the driver to the driver's seat by a strap. While this attempt provides stabilization of the driver's head in relation to the driver's seat, it does not provide stabilization of the driver's head in relation to the driver's torso. During an accident, the driver's head may still be permitted to be violently forced forwarded, forced to the left or forced to the right in relation to the strapped-in driver's torso. Another attempt to prevent injuries to the driver's neck and head during an accident involved the driver wearing a yoke positioned on the his shoulders. The yoke along with the driver is strapped to the driver's seat. The driver's helmet is connected to the yoke via a pair of moveable rods positioned on either side of the helmet. The rods move on a pair of arcuate tracks positioned on the yoke thereby allowing movement of the driver's head in the horizontal plane with respect to the driver's field of view. During an accident, the rods permit the driver's head to rotate in the vertical plane in relation to the yoke and may cause neck injuries to the driver.

SUMMARY OF THE INVENTION

The present invention is an apparatus worn by a driver of a high performance competition vehicle to prevent head and neck injuries to the driver during an accident. The apparatus fits over the driver's head and shoulders and via a plurality of adjustable straps is secured to the torso of the driver. The apparatus may, if desired, be adjustably positioned on the driver to accommodate the driver in a full upright-seated position or in a modified seated position within the confines of the vehicle. Typically, the field of view of the driver of the high performance competition type vehicle is directed forward in front of the vehicle, to the right or to the left of the vehicle i.e. the driver's field of view is in the horizontal plane parallel to the direction of travel of the vehicle. The instrument panel of the competition vehicle is in the field of view of the driver during competition; therefore, movement of the driver's head in the vertical plane is not required. The driver of the high performance competition type vehicle having use of the present invention is able to move his head in the horizontal plane relative to his field of view but is not permit movement of his head in the vertical plane relative to his field of view.

The apparatus has a yoke with an aperture sized to receive the driver's head. The head of the driver passes through the aperture and the yoke rests on the driver's shoulders. The yoke has a front portion seamlessly attached to a rear portion. A plurality of straps is adjustably connected to the yoke and about the driver thereby adjustably securing the yoke's front and rear portions to the driver's torso.

A helmet is vertically aligned with the yoke's aperture and adjacently spaced from the yoke's front and rear portions. The helmet fits over the driver's head and extends to below the driver's jaw line. The helmet has a visor area enabling unrestricted full field of view for the driver. The helmet is connected to the yoke via a first and second pair of elongated substantially L-shaped flanges.

The first pair of elongated substantially L-shaped flanges are adjustably secured to either side of the yoke's aperture. The first pair of elongated substantially L-shaped flanges each have a curved portion. The curved portion is formed to accommodate the arched portion of the yoke resting on the driver's shoulders. Each curved portion has a flat substantially rectangular portion perpendicularly connected along its longitudinal length. The first pair of elongated substantially L-shaped flanges are adjustably secured to the yoke's front and rear portions via a plurality of slots and retaining nuts and bolts.

The second pair of elongated substantially L-shaped flanges are juxtaposition the first pair of elongated substantially L-shaped flanges. The second pair of elongated substantially L-shaped flanges are adjustably secured to either side of the helmet via a pair of slots. The slots allow the helmet to be adjusted up or down in the vertical plane to accommodate the position of the driver's head in relation to the driver's shoulders. After the helmet is adjusted, it is secured to the second pair of elongated substantially L-shaped flanges by a plurality of nuts and bolts. Each flange has a flat substantially rectangular portion perpendicularly connected along its longitudinal length. Each substantially rectangular flat portion has an elongated arcuate slot extending along its longitudinal length. The second pair of elongated substantially L-shaped flange's substantially rectangular flat portions are juxtaposition to the first pair of elongated substantially L-shaped flange's substantially rectangular flat portions.

At least one pair of quick-release mechanisms may, if desired, be installed via the arcuate slots to secure the first pair of elongated substantially L-shaped flanges to the second pair of elongated substantially. L-shaped flanges. As the driver rotates his head from right to left or left to right the second pair of elongated substantially L-shaped flanges arcuately traverses the first pair of elongated substantially L-shaped flanges. The arcuate movement is derived from the quick-release mechanism traversing the second pair of elongated substantially L-shaped flanges' arcuate slots. This action causes the second pair of elongated substantially L-shaped flanges to rotate in the horizontal plane in relation to the first pair of elongated substantially L-shaped flanges. The head of the driver is restricted to rotational movements in the horizontal plane and is prohibited from rotational head movements in the vertical plane.

In operation, the helmet is attached to the second pair of elongated substantially L-shaped flanges and in concert with the first pair of elongated substantially L-shaped flanges is adjustably secured to accommodate the driver in a full upright seated position or in a modified seated position within the confines of the vehicle. When the driver is in the full upright-seated position, his head and torso are perpendicular to his field of view i.e., the field of view is parallel to the horizontal plane. The helmet and the first and second pairs of elongated substantially elongated L-shaped flanges are adjusted forward or backward across the yoke via the yoke's slots to maintain the driver's field of view in the horizontal plane. Once adjusted the first pair of elongated substantially elongated L-shaped flanges are secured in place by a plurality of nuts and bolts.

When the driver is in the modified seated position, the driver's torso is semi-reclined thereby requiring the head of the driver to be rotated forward toward his chest area to allow full field of view in the horizontal plane while operating the vehicle. To accommodate the driver in the modified seated position the helmet and the first and second pairs of elongated substantially elongated L-shaped flanges are adjusted forward across the yoke and secured (as discussed above).

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figure 1:
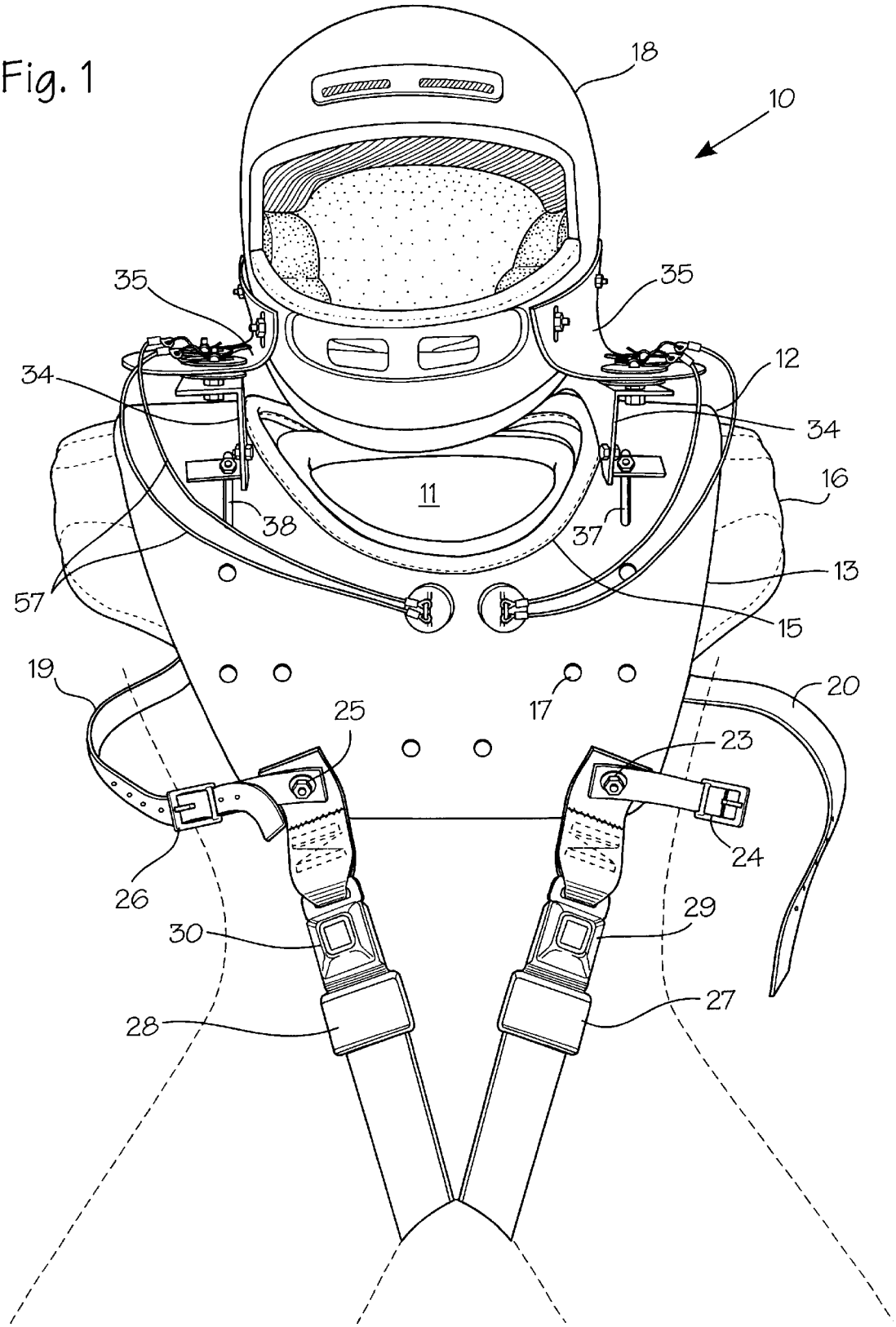
FIG. 1 illustrates a front schematic view of the preferred embodiment of the present invention.

An overview of the present invention 10, FIG. 1: The present invention 10 is an apparatus for supporting the head and neck of a driver or user of a high performance vehicle. An example of a high performance vehicle is a competition vehicle of the type used for traveling at high speeds on a closed, controlled racetrack. Typically, the field of view of the driver or user of a competition vehicle is directed forward, to the right or to the left of the vehicle i.e. the driver's or user's field of view is in the horizontal plane parallel to the direction of travel of the vehicle. The instrument panel of a competition vehicle is in the field of view of the driver or user during a race; therefore, movement of the driver's or user's head in the vertical plane is not required. The driver or user of the present invention 10 is able to move his head in the horizontal plane relative to his field of view but is not permitted to move his head in the vertical plane relative to his field of view.

The present invention 10, FIG. 1 is worn by a user or driver of a competition vehicle. The user or driver has his head and neck secured in the horizontal plane with a full field of view from the driver's or user's extreme right to the extreme left. The driver's or user's head position in the vertical plane, is predetermined and secured. The user's or driver's head movement in the vertical plane during the operation of the competition vehicle is prohibited.

A more detailed discussion of the preferred embodiment of the present invention 10, FIG. 1: The preferred embodiment of the present invention 10 has a yoke 12 with an aperture 11 sized to receive a user's head. The rim of the aperture 11 is padded 15. The head of the user passes through the aperture 11 and the yoke 12 rests on the user's shoulders. The yoke 12 has a front portion 13 extends from the user's shoulders to below the user's chest area. The front portion 13 is seamlessly attached to a rear portion 14. The rear portion 14 extending from the user's shoulders to below the user's shoulder blades. The present invention 10 has a helmet 18 vertically aligned with the yoke's 12 aperture 11 and adjacently spaced from the yoke's 12 front and rear portions 13 and 14, respectively. The underside of yoke's 12 front portion 13 and rear portion 14, facing the user, are padded 16 with any convenient material of comfort to the user. Examples of padded 16 material are foam and layered cotton. The yoke's 12, front portion 13 and rear portion 14 may, if desired, be fabricated from any convenient material known in the art. Examples of convenient materials are metal, fiberglass, nylon, Kevlar or any combination of the aforementioned materials.

A first strap 20, FIG. 1 has one end 21 connected to the yoke's 12 rear portion 14 below the user's shoulder blade. The other end of the first strap 20 is connected to the yoke's 12 front portion 13 below the user's chest at 23. The two ends of the first strap 20 may, if desired, be joined by a buckle 24. A second strap 19 has one end 22 connected to the yoke's 12 rear portion 14 below the user's shoulder blade. The other end of the second strap 19 is connected to the yoke's 12 front portion 13 below the user's chest at 25. The two ends of the second strap 19 may, if desired, be joined by a buckle 26. A third strap 27 has one end connected to the yoke's 12 front portion 13 and the other end connected to the rear portion 14. The third strap 27 passes over the user's buttocks around the left leg and is secured by a quick-release mechanism 29. A fourth strap 28 has one end connected to the yoke's 12 front portion 13 and the other end connected to the rear portion 14. The fourth strap 28 passes over the user's buttocks around the right leg and is secured by a quick-release mechanism 30. The first 20, second 19, third 27 and fourth 28 straps may, if desired, be fabricated from any convenient material known in the art of retaining strap manufacture. Examples of retaining strap materials are woven nylon, cotton or any combination of polymer and non-polymer materials.

In operation, the first strap 20, FIG. 1 passes under the user's left arm and the second 19 strap passes under the user's right arm. The first strap 20 and second strap 19 are adjusted to accommodate the torso of the user and are adjustably secured via buckles 24 and 26. The first strap 20 and second strap 19 are tightened to secure the yoke's 12 front portion 13 and rear portion 14 to the user's upper torso. The third strap 27 passes over the user's buttocks around the left leg and is adjusted to accommodate the user in a seated position via the quick-release mechanism 29. A fourth strap 28 has one end connected to the yoke's 12 front portion 13 and the other end connected to the yoke's 12 rear portion 14. The fourth strap 28 passes over the user's buttocks around the right leg and is adjusted to accommodate the user in a seated position via the quick-release mechanism 30. The third strap 27 and fourth 28 straps are tightened to secure the yoke 12 to the user's shoulders. The quick-release mechanisms 29 and 30 may, if desired, be any convenient type of quick-release mechanism known in the art that enables the user to quickly release the third strap 27 and fourth strap 28 from the user's torso. The combination of the plurality of straps implemented, adjustably secures the yoke 12 to the torso of the user.

The helmet 18, FIG. 1 is vertically aligned and adjacently spaced from the yoke's 12 aperture 11. The helmet 18 fits over the user's head and extends to below the user's jaw line. The helmet 18 has a visor area 31, FIG. 2 enabling unrestricted full field of view for the user. The interior of the helmet is padded and the padding extends around the lower portion 32 of the helmet 18. The padding also extends around the rim 33 of the visor area 31. The helmet 18 is connected to the yoke 12 via a first and second pair of elongated substantially L-shaped flanges 34 and 35, respectively.

Figure 2:
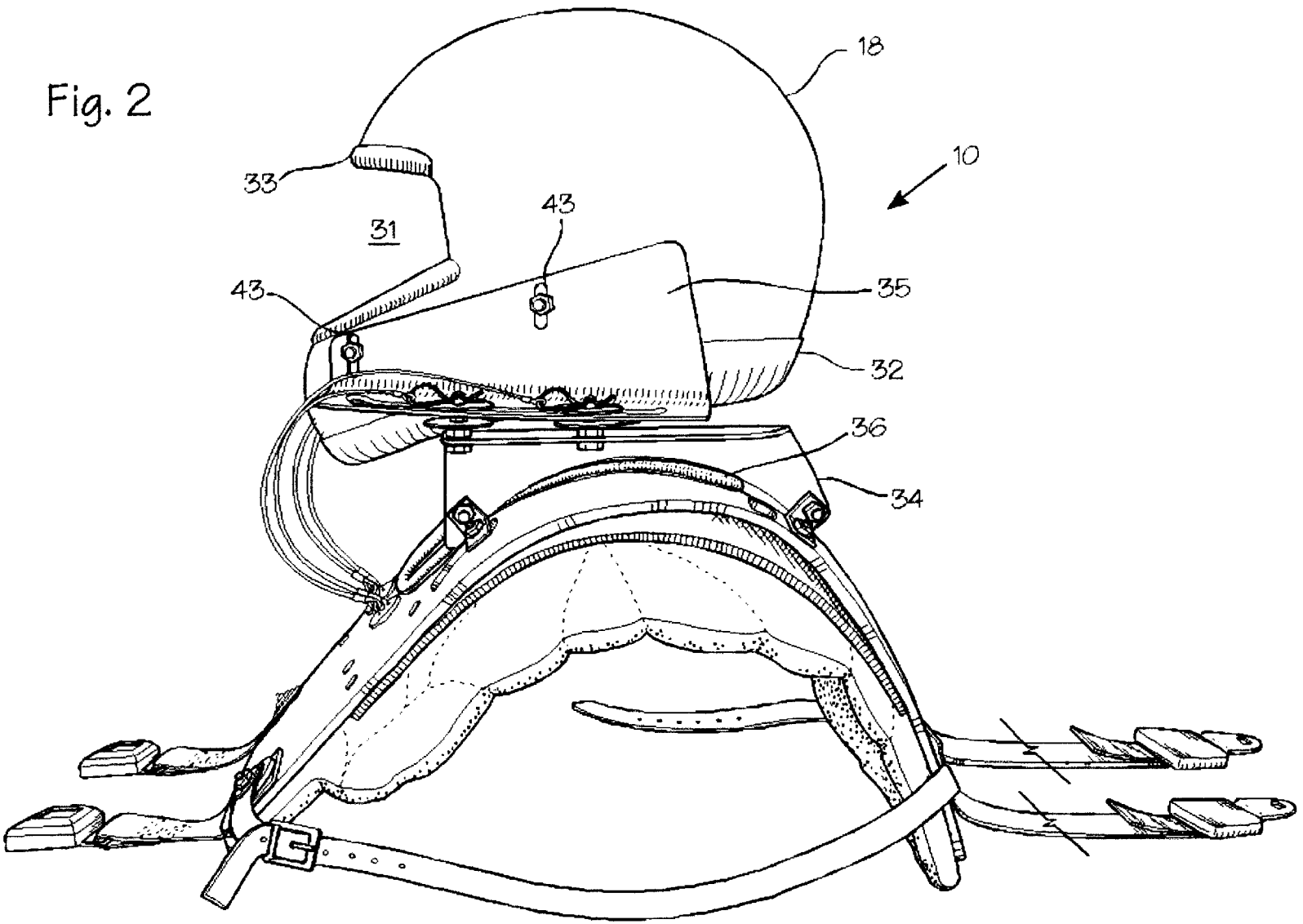
FIG. 2 illustrates a side schematic view of the present invention.
Figure 6:
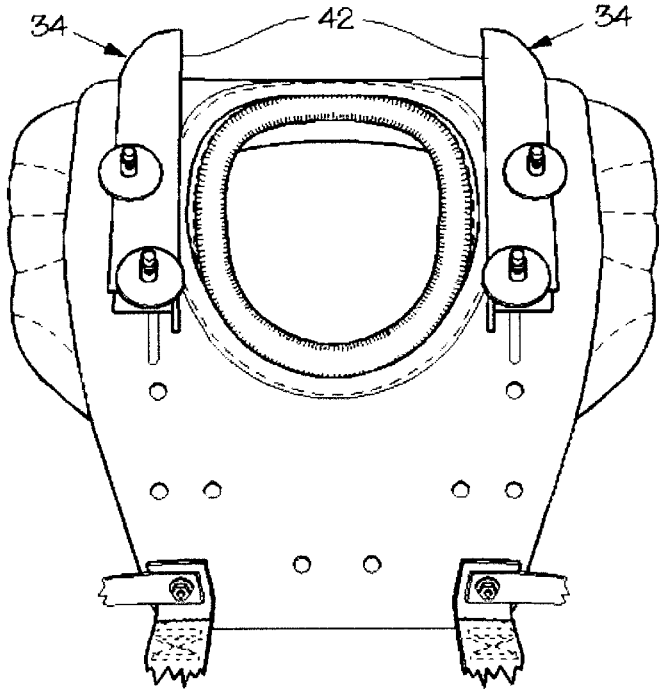
FIG. 6 illustrates a top schematic view of the present invention of FIG. 1.

The first pair of elongated substantially L-shaped flanges 34, FIG. 2 each have a curved portion 36. Each elongated curved portion 36 has a flat substantially rectangular portion 42, FIG. 6 perpendicularly connected along its longitudinal length. The curved portion 36 is formed to accommodate the arched portion of the yoke 12. The first pair of elongated substantially L-shaped flanges 34 is adjustably secured to the yoke's 12 front portion 13 and rear portion 14 via a plurality of slots 37, 38, 39 and 40 and retaining nuts and bolts.

The second pair of elongated substantially L-shaped flanges 35, FIG. 2 is juxtaposition the first pair of elongated substantially L-shaped flanges 34. The second pair of elongated substantially L-shaped flanges 35 is adjustably secured to either side of the helmet 18 via a pair of slots 43. The slots 43 enable the helmet 18 to be adjusted up or down in the vertical plane to accommodate the position of the user's head in relation to the user's shoulders. After the helmet 18 is adjusted, it is secured to the second pair of elongated substantially L-shaped flanges 35 by a plurality of nuts and bolts. Each flange of the second pair of elongated substantially L-shaped flanges 35 has a flat substantially rectangular portion 44, FIG. 7*a* extending along the longitudinal length of each flange. Each flat substantially rectangular portion 44 has an elongated arcuate slot 45 extending along its the longitudinal length. The second pair of elongated substantially L-shaped flanges' 35 flat substantially rectangular portions 44 is juxtaposition to the first pair of elongated substantially L-shaped flanges' 34 flat substantially rectangular portions 42.

Figure 7A:
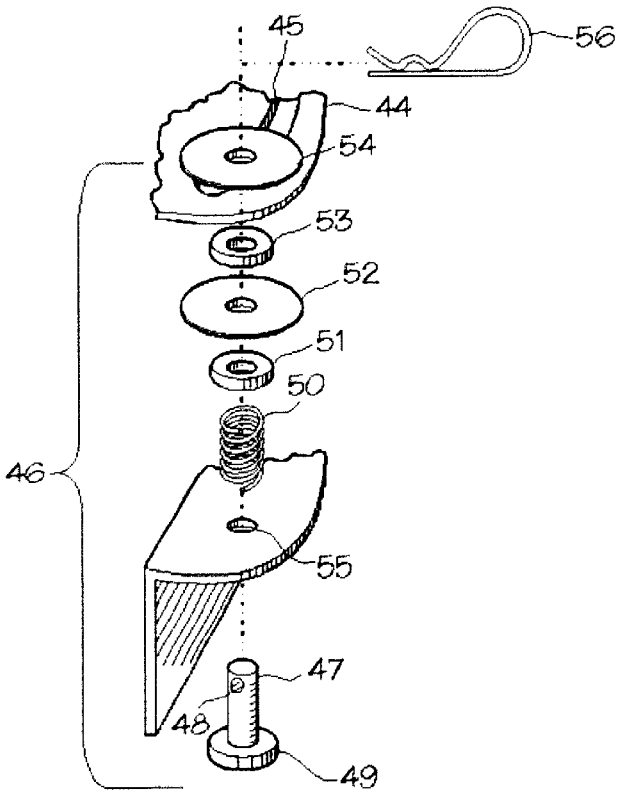
FIG. 7*a* illustrates an exploded schematic view of a first quick-release retaining mechanism of the present invention of FIG. 1.

At least one pair of quick-release mechanisms 46, FIG. 1 may, if desired, be installed to secure the first pair of elongated substantially L-shaped flanges 34 to the second pair of elongated substantially L-shaped flanges 35 via arcuate slots 45. A single quick-release mechanism 46 is depicted in FIG. 7*a*. Both quick-release mechanisms of the pair are identical; therefore, only one quick-release mechanism will be discussed. The quick-release mechanism 46 has an elongated cylinder 47. The elongated cylinder 47 has an aperture 48 disposed in one end. The elongated cylinder's 47 other end, oppositely spaced from the first end, has an annular shoulder 49 disposed thereon. The elongated cylinder 47 is inserted through aperture 55 until the annular shoulder 49 engages the underside of the flat substantially rectangular portion 42. A spring 50 is insert over the elongated cylinder 47. A flat washer 51 is installed over the elongated cylinder 47 engaging the spring 50. A second washer 52 larger than the washer 51 is installed over the elongated cylinder 47 engaging the washer 51. A third washer 53, of the same size as the washer 51 is installed over the elongated cylinder 47 engaging washer 52. The elongated cylinder 47 is inserted through the arcuate slot 45 until washer 53 engages the underside of the flat substantially rectangular portion 44. A washer 54, of the same size as washer 52 is installed over the elongated cylinder 47. The quick-release mechanism 46 is compressed urging the spring 50 against the flat substantially rectangular portion 42 and washer 51. A key 56 is inserted through the aperture 48 securing the flat substantially rectangular portion 42 to the flat substantially rectangular portion 44. If desired, a retaining cable 57, FIG. 1 may be connected to the key 56 and the yoke's 12 front portion 13. The washers 51, 52, 53 and 54 may, if desired, be fabricated from metallic, non-metallic or a combination of metallic and non-metallic materials.

Figure 7B:
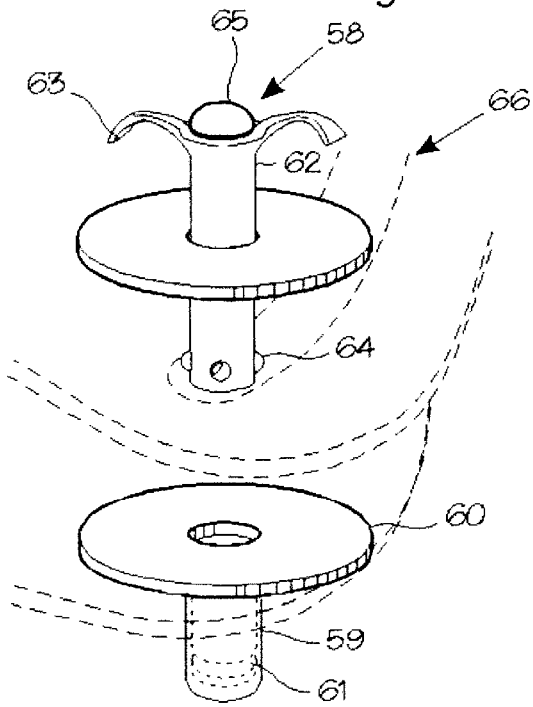
FIG. 7*b* illustrates a perspective schematic view of a second quick-release retaining mechanism of the present invention of FIG. 1.

If desired, an alternate quick-release mechanism 58, FIG. 7*b* may be used in place of or in conjunction with quick-release mechanism 46. The quick-release mechanism 58 has a first elongated cylinder 59 with one end open and the other end closed. The quick-release mechanism 58 has an outwardly extending annular shoulder 60 disposed about its open end. The first elongated cylinder's 59 interior wall has an annular concave indentation 61 adjacently disposed to the closed end. The quick-release mechanism 58 has a second elongated cylinder 62 that is slidably insertable into the first elongated cylinder 59. The second elongated cylinder 62 has a pair of finger grips 63 connected at one end. At least one sphere 64 is outwardly extending from the second elongated cylinder's 62 outer wall adjacent to the cylinder's other end. When the second elongated cylinder 62 is inserted into the first elongated cylinder 59 at least one sphere 64 engages the annular indentation 61 thereby locking the second elongated cylinder 62 within the confines of the first elongated cylinder 59. A push-button 65 is mounted between the finger grips 63. The push-button 65 is connected to at least one sphere 64. In operation, pressing downward on the push-button 65 disengages at least one sphere 64 thereby releasing the second elongated cylinder 62 from the confines of the first elongated cylinder 59. Releasing the push-button 65 forces at least one sphere 64 into the annular indentation 61 thereby locking the second elongated cylinder 62 within the confines of the first elongated cylinder 59.

In operation, the helmet 18, FIG. 1 is adjustably secured to the second pair of elongated substantially L-shaped flanges 35 and in concert with the first pair of elongated substantially L-shaped flanges 34, is adjustably secured to accommodate the user in a full upright seated position or in a modified seated position within the confines of the vehicle. When the user is in the full upright-seated position, his head and torso are perpendicular to his field of view i.e., the field of view is parallel to the horizontal plane. The first pair of elongated substantially L-shaped flanges' 34 is positioned forwards or backwards across yoke 12 via slots 37, 38, 39 and 40 to maintain the flat substantially rectangular portions 42 parallel to the horizontal plane. Once adjusted the first pair of elongated substantially elongated L-shaped flanges' 34 is secured in place by a plurality of nuts and bolts.

The modified seated position the driver's torso is semi-reclined thereby requiring the head of the user to be rotated forward toward his chest area to allow full field of view in the horizontal plane while operating the vehicle. To accommodate the user in the modified seated position the first pair of elongated substantially elongated L-shaped flanges 34 is rotated forward across yoke 12 via slots 37, 38, 39 and 40 thereby maintaining the flat substantially rectangular portions 42 parallel to the horizontal plain. Once adjusted the first pair of elongated substantially elongated L-shaped flanges 34 is secured in place by a plurality of nuts and bolts.

At least one pair of quick-release mechanisms 46, FIG. 7*a* or 66, FIG. 7*b* is installed (as discussed above). If desired, more than one pair of quick-release mechanisms 46 or 66 may be installed. As the user of rotates his head from right to left or from left to right the second pair of elongated substantially L-shaped flanges 35 arcuately traverses the first pair of elongated substantially L-shaped flanges 34. The arcuate movement is derived from the quick release mechanism's 46 or 66 elongated cylinder 47 or 62 respectively traversing the second pair of elongated substantially L-shaped flanges' 35 arcuate slots 45. This action causes the second pair of elongated substantially L-shaped flanges 35 to rotate in the horizontal plane in relation to the first pair of elongated substantially L-shaped flanges 34. The head of the user is restricted to movements in the horizontal plane and no movement in the vertical plane.

Figure 3A:
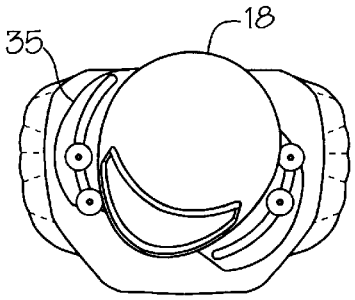
FIG. 3*a* illustrates a top schematic view of the extreme right field of view of the user seated in the full upright position.
Figure 3B:
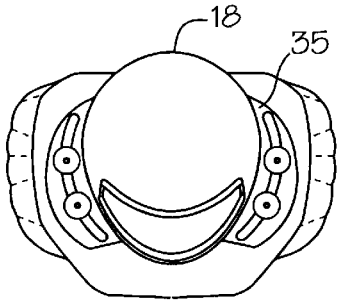
FIG. 3*b* illustrates a top schematic view of the forward field of view of the user seated in the full upright position.
Figure 3C:
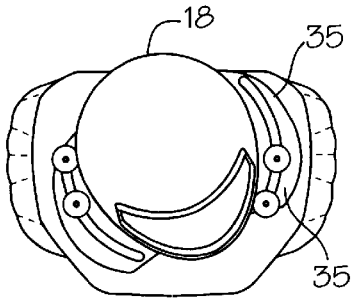
FIG. 3*c* illustrates a top schematic view of the extreme left field of view of the user seated in the full upright position.
Figure 4A:
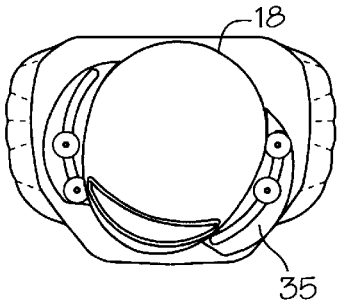
FIG. 4*a* illustrates a top schematic view of the extreme right field of view of the user in the modified seated position.
Figure 4B:
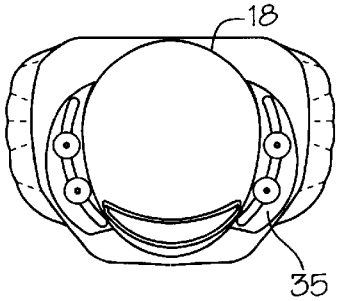
FIG. 4*b* illustrates a top schematic view of the forward field of view of the user in the modified seated position.
Figure 4C:
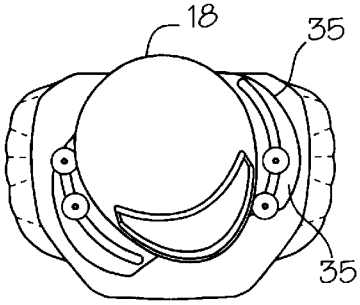
FIG. 4*c* illustrates a top schematic view of the extreme left field of view of the user in the modified seated position.
Figure 5:
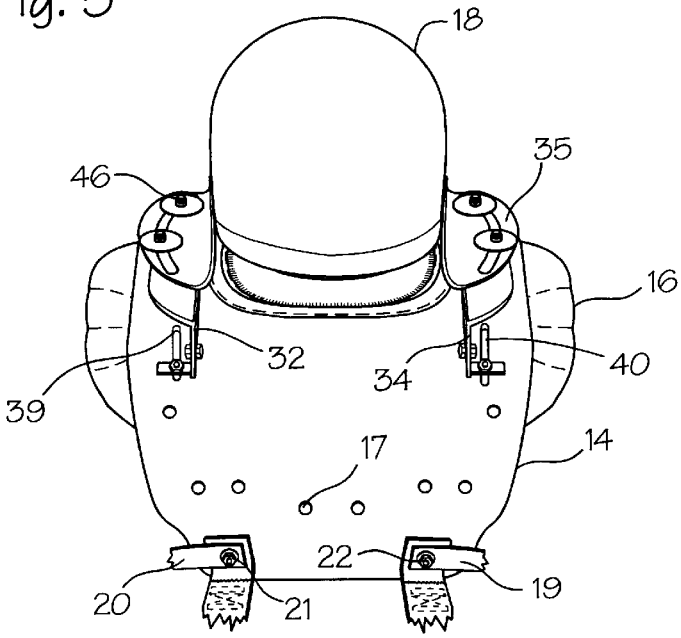
FIG. 5 illustrates a rear schematic view of the present invention of FIG. 1.

In the full upright seated position the user of the present invention 10, FIG. 3*a* is able to alter his field of view in the horizontal plane from forward field of view FIG. 3*b*, to the extreme right field of view FIG. 3*a* and to the extreme left field of view FIG. 3*c*. The user of the present invention 10, FIG. 4*b* in the modified seated position is able to alter his field of view in the horizontal plane from forward field of view FIG. 4*b*, to the extreme right field of view FIG. 4*a* and to the extreme left field of view FIG. 4*c*.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. Means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An apparatus for supporting a user's head and neck in the vertical plane while enabling user head movement in the horizontal plane with respect to the user's field of view, the apparatus having a yoke with an aperture sized to receive the user's head, the yoke resting on the user's shoulders, the yoke having a front portion extending from the user's shoulders to below the user's chest area, the front portion having a seamlessly attached rear portion extending from the user's shoulders to below the user's shoulder blades, the apparatus having a helmet vertically aligned with the yoke's aperture and adjacently spaced from the yoke's front and rear portions, comprising:

a.) a first pair of elongated substantially L-shaped flanges, each said L-shaped flange mountably disposed on either side of the yoke's aperture, each said L-shaped flange having a first end adjustably secured to the yoke's front portion, each said L-shaped flange having a second end oppositely spaced from said first end, said second end adjustably secured to the yoke's rear portion;

b.) a second pair of elongated substantially L-shaped flanges juxtaposition said first pair of elongated L-shaped flanges, said second pair of elongated substantially L-shaped flanges adjustably secured to either side of the helmet;

c.) said second pair of elongated substantially L-shaped flanges each having an arcuate slot disposed along the longitudinal length of each said L-shaped flange;

d.) at least one pair of elongated quick-release assemblies, each said elongated quick-release assembly extending through each said arcuate slot;

whereby said second pair of elongated substantially L-shaped flanges arcuately rotating in relation to said first pair of elongated substantially L-shaped flanges via said quick-release assemblies enabling the user arcuate head movement in the horizontal plane with respect to the user's field of view.

2. An apparatus for supporting a user's head and neck as recited in claim 1 wherein each of said first pair of elongated substantially L-shaped flange's first and second ends being adjustably secured via two pairs of slots, each pair of slots disposed on either side of the yoke's aperture on its front and rear portions respectively, said first and second ends of each L-shaped flange having means for adjustably connecting said first pair of elongated substantially L-shaped flanges via said slots to said yoke's front and rear portions respectively whereby said slots enable adjustment of said first pair of elongated substantially L-shaped flanges in the horizontal plane with respect to the user's field of view.

3. An apparatus for supporting a user's head and neck as recited in claim 2 wherein said second pair of elongated substantially L-shaped flanges adjustably secure to either side of the helmet via a plurality of slots enabling vertical positioning of the helmet with respect to said second pair of elongated substantially L-shaped flanges.

4. An apparatus for supporting a user's head and neck as recited in claim 1 wherein said second pair of elongated substantially L-shaped flanges is juxtaposition in the horizontal plane with respect to said first pair of elongated substantially L-shaped flanges.

5. An apparatus for supporting a user's head and neck as recited in claim 4 wherein said second pair of elongated substantially L-shaped flanges having a first position in the horizontal plane with respect to said first pair of elongated substantially L-shaped flanges enabling lateral movement of the helmet via said second pair of elongated substantially L-shaped flange's arcuate slots in concert with said at least one pair of elongated quick-release assemblies.

6. An apparatus for supporting a user's head and neck as recited in claim 5 wherein said second pair of elongated substantially L-shaped flanges having a second position arcuately spaced from said first position via said second pair of elongated substantially L-shaped flange's arcuate slots in concert with said at least one pair of elongated quick-release assemblies.

7. An apparatus for supporting a user's head and neck as recited in claim 1 further comprising a plurality of retaining straps adjustably securing the user to the apparatus.

8. An apparatus for supporting a user's head and neck as recited in claim 2 wherein each said pair of elongated quick-release assemblies comprises:

a.) a pair of elongated cylinders, each said cylinder having an annular shoulder disposed on one end, the other end of each said cylinder having an aperture disposed therein;

b.) a pair of springs inserted over said cylinders, said springs having one end engaging said cylinder's annular shoulder;

c.) a first pair of retaining washers inserted over said cylinders engaging each said spring;

d.) a second pair of retaining washers inserted over said cylinders engaging each said first washer;

e.) a retaining clip insert through said cylinder's aperture;

f.) said retaining clip being connectively disposed to the apparatus's front portion via a flexible member;

whereby said springs urge said washers along said cylinders while being secured by said retaining clips.

9. An apparatus for supporting a user's head and neck as recited in claim 2 wherein each said pair of elongated quick-release assemblies comprises:

a.) a first pair of elongated cylinders each having an interior wall, each said cylinder having one end closed and the other oppositely spaced end open;

b.) said first pair of cylinder's open end having an outwardly extending annular shoulder disposed thereto;

c.) said first pair of elongated cylinder's interior walls each having an annular indentation adjacently spaced from said closed end;

d.) a second pair of elongated cylinders slidably insertable into said first pair of elongated cylinders;

e.) said second pair of elongated cylinders each having a first end and a second closed end oppositely spaced from said first end, said first end having a finger graspable push-button release mechanism installed therein;

f.) said second pair of elongated cylinders each having at least one retaining sphere adjacently spaced from each said closed end, each said retaining sphere operatively disposed to said finger graspable push-button release mechanism;

g.) said second pair of elongated cylinder's respective said retaining spheres engaging said annular indentation;

whereby said retaining spheres lock said second pair of elongated cylinders to said first pair of elongated cylinders and said finger graspable push-button release mechanism releases said second pair of elongated cylinders from said first pair of elongated cylinders.

10. An apparatus for supporting a user's head and neck in the vertical plane while enabling user head movement in the horizontal plane with respect to the user's field of view, the apparatus having a yoke with an aperture sized to receive the user's head, the yoke resting on the user's shoulders, the yoke having a front portion extending from the user's shoulders to below the user's chest area, the front portion having a seamlessly attached rear portion extending from the user's shoulders to below the user's shoulder blades, the apparatus having a helmet vertically aligned with the yoke's aperture and adjacently spaced from the yoke's front and rear portions, comprising:

a.) a first pair of elongated substantially L-shaped flanges, each said elongated substantially L-shaped flange having an elongated curved portion positioned on either side of the yoke's aperture, each said curved portion having a first end connecting to the yoke adjacent to the yoke's front portion via a slot, each said curved portion having a second end connecting to yoke adjacent to the yoke's rear portion via a slot;

b.) said first pair of elongated substantially L-shaped flange each having an elongated substantially rectangular flat portion perpendicularly connected to each said elongated substantially L-shaped flange's curved portion;

c.) said first pair of elongated substantially L-shaped flanges being positionally adjusted via said slots to maintain said elongated substantially rectangular flat portion in the horizontal plane in respect to the user's field of view;

d.) a second pair of elongated substantially L-shaped flanges, juxtaposition said first pair of elongated substantially L-shaped flanges, said second pair of elongated substantially L-shaped flanges each having a pair of slots for positioning and securing the helmet in the vertical plane to said elongated substantially L-shaped flanges;

e.) said second pair of elongated substantially L-shaped flanges each having an arcuate slot disposed along the longitudinal length of each said L-shaped flange;

f.) at least one pair of elongated quick-release assemblies, each said elongated quick-release assembly extending through each said arcuate slot slidably connecting said second pair of elongated substantially L-shaped flanges to said first pair of elongated substantially L-shaped flanges;

g.) said at least one pair of elongated quick-release assemblies each having a retaining cable connected to the yoke's front portion whereby said retaining cable providing retention for the elongated quick-release assemblies when disengaged from said first and second pairs of elongated substantially L-shaped flanges;

whereby said second pair of elongated substantially L-shaped flanges arcuately rotates in relation to said first pair of elongated substantially L-shaped flanges via said quick-release assemblies enabling the user arcuate head movement in the horizontal plane with respect to the user's field of view.

* * * * *